US005505632A

United States Patent [19]

Hayashi et al.

[11] Patent Number: 5,505,632

[45] Date of Patent: Apr. 9, 1996

[54] CONNECTOR HAVING ROTATION GUIDE

[75] Inventors: Hiroyuki Hayashi; Shinichi Yamada, both of Yokkaichi, Japan

[73] Assignee: Sumitomo Wiring Systems, Ltd., Mie, Japan

[21] Appl. No.: 223,657

[22] Filed: Apr. 6, 1994

[30] Foreign Application Priority Data

Apr. 16, 1993 [JP] Japan ..... 5-113912

[51] Int. Cl.[6] ..... H01R 4/54

[52] U.S. Cl. ..... 439/318

[58] Field of Search ..... 439/310, 311, 439/312, 313, 314, 316, 317, 318, 319, 320, 322, 924

[56] References Cited

U.S. PATENT DOCUMENTS

| | | | |
|---|---|---|---|
| 2,690,542 | 9/1954 | Pearce et al. | 439/314 |
| 3,287,031 | 11/1966 | Simmons et al. | 439/319 |
| 3,343,852 | 9/1967 | Blight et al. | 439/321 |
| 3,569,908 | 3/1971 | Appleton | 439/924 |
| 3,719,918 | 3/1973 | Kerr | 439/319 |
| 3,869,186 | 4/1975 | Vetter | 439/321 |
| 4,457,469 | 7/1984 | Ratchford | 439/312 |
| 4,457,572 | 7/1984 | Frazier et al. | 439/312 |
| 4,462,652 | 7/1984 | Werth et al. | 439/312 |

FOREIGN PATENT DOCUMENTS

| | | |
|---|---|---|
| 4-124774 | 11/1992 | Japan . |
| 4-334908 | 11/1992 | Japan . |

*Primary Examiner*—Gary F. Paumen
*Assistant Examiner*—Hien D. Vu
*Attorney, Agent, or Firm*—Oliff & Berridge

[57] ABSTRACT

A charger-side connector is moved toward a battery-side connector through the engagement of a positioning projection formed on the battery-side connector in a guide groove formed on the charger-side connector by rotating an outer tube. At this time, the outer tube is retained relative to an inner tube in predetermined positional relation by straight grooves and plunger mechanisms. The retaining positions are determined in accordance with conditions of connection between power and signal terminals of one connector and power and signal terminals of the other connector, and therefore the rotational condition as viewed from the outside indicates the connected condition of the terminals.

19 Claims, 6 Drawing Sheets

CONNECTOR HAVING ROTATION GUIDE

BACKGROUND OF THE INVENTION

This invention relates to a connector, and more particularly to a connector having a rotation guide for guiding an engagement movement by rotating an outer tube.

A conventional connector having a rotation guide is known as shown in FIG. 13.

One connector 1 has an external thread 2 formed on an outer peripheral surface of an end portion thereof, and the other connector 3 has at its outer periphery a rotation ring 5 having an internal thread 4 threadedly engageable with the external thread 2.

The two connectors 1 and 3 are disposed in opposed relation to each other, and the rotation ring 5 is rotated to threadedly engage the internal thread 4 with the external thread 2, so that the connectors 1 and 3 are moved toward each other, and are electrically connected together. By rotating the rotation ring 5 in the opposite direction, the connectors 1 and 3 are disengaged from each other, thereby breaking the electrical connection.

In the above conventional connector with the rotation guide means, the electrical connection and disconnection are achieved by rotating the rotation ring 5. However, the electrically-connected condition can not be easily made merely by rotating the rotation ring 5, and therefore there has been encountered a problem that a half-connected condition in which the connection is incomplete can occur.

SUMMARY OF THE INVENTION

The present invention has been made in view of the above problem, and an object of the invention is to provide a connector with rotation guide means in which an electrically-connected condition can be easily made, and a half-connected condition hardly occurs.

According to the invention, there is provided a connector having a rotation guide wherein an outer tube having a spiral engagement groove is rotatably mounted on an outer periphery of an inner tube having terminals received therein and facing an open end of the outer tube; and the inner tube is inserted into a mating connector having an engagement projection formed on its cylindrical peripheral surface, and the outer tube is rotated with the engagement projection engaged in the engagement groove, thereby moving the two connectors toward and away from each other; a spring mechanism for urging the outer tube toward a start position from between the start position where the outer tube is disposed before starting the fitting and a completed position where the outer tube is disposed after completing the fitting with respect to a positional relation between the outer tube and the inner tube; and a retaining mechanism for retaining the outer tube and the inner tube against the spring mechanism at such positions that the outer and inner tubes can be disposed in predetermined rotational relation to each other.

Furthermore, according to the invention, the retaining mechanism comprises a plunger mounted on the outer tube and directed toward an outer peripheral surface of the inner tube, and straight grooves formed in the outer peripheral surface of the inner tube and extending along an axis thereof, the plunger being retainingly engageable in the straight grooves.

In the invention of the above construction, the spring mechanism urges the outer tube toward the start position when the outer tube is rotated, and when the outer tube is rotated toward the completed position, the outer tube is rotated against this spring mechanism. On the other hand, at positions other than those positions where the outer tube and the inner tube are disposed in predetermined rotational relation, the outer tube is urged back toward the initial position, and at those positions where the predetermined rotational relation is established, the retaining mechanism retain the two tubes relative to each other.

Furthermore, according to the invention, for retaining the two tubes by the retaining mechanism, the straight grooves are formed in the outer peripheral surface of the inner tube, and extend along the axis thereof. The positional relationship between the outer tube and these straight grooves indicates the rotational position of the outer tube having the plunger.

As mentioned above, according to the present invention, the outer tube, if not rotated until the predetermined positional relation is established, is returned, and therefore there is provided the connector having a rotation guide in which the connector can not be held in a half-engaged condition.

Furthermore, the straight grooves in the inner tube also serve to indicate the rotational position of the outer tube, and therefore the engaged condition can be easily indicated simultaneously with the retaining of the outer tube.

DETAILED DESCRIPTION OF PREFERRED EMBODIMENTS

One preferred embodiment of the present invention will now be described with reference to the drawings. In this embodiment, there is provided a connector for charging an electric car.

Figure 1:
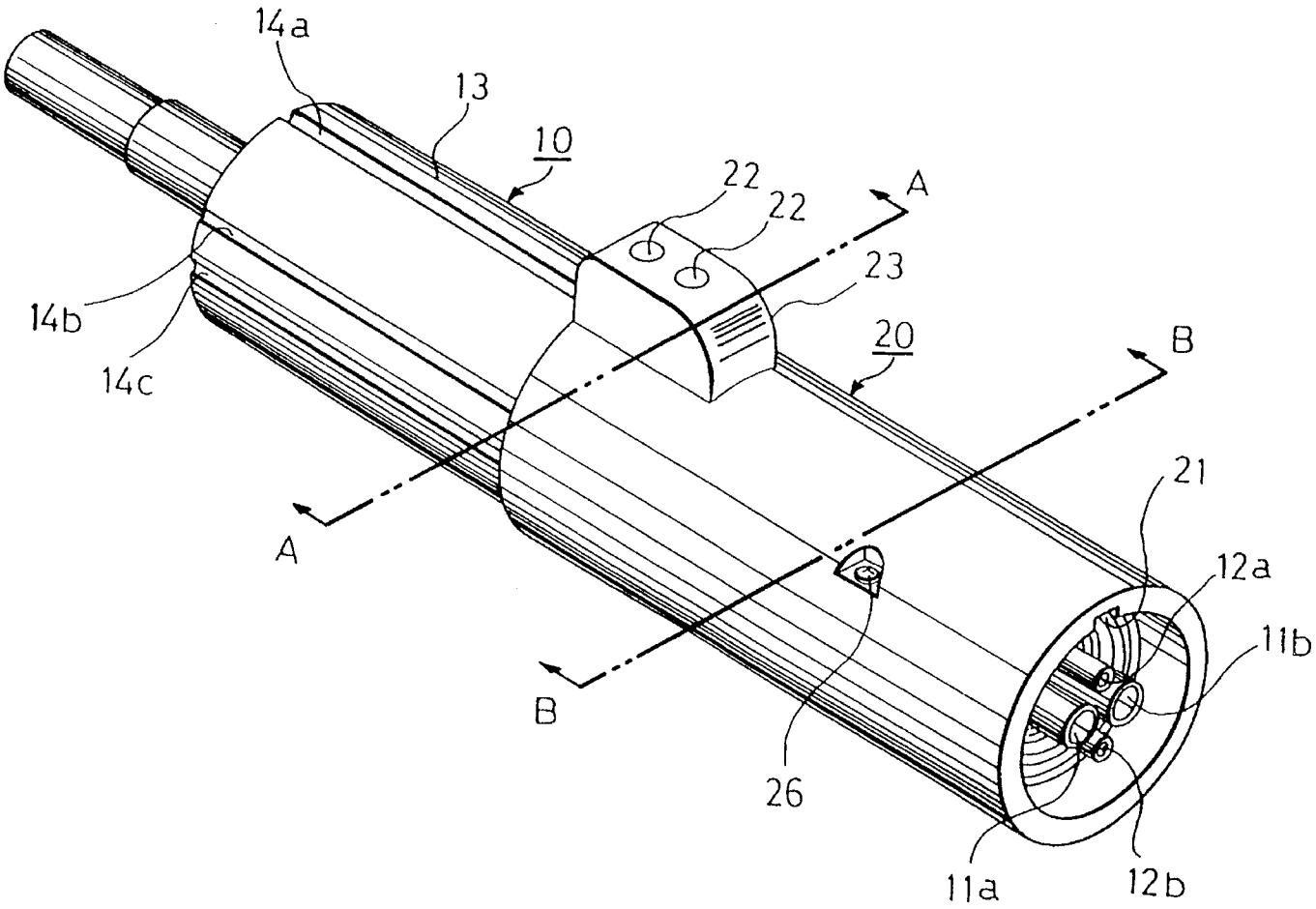
FIG. 1 is a perspective view of a charger-side connector that is one preferred embodiment of a connector of the invention having a rotation guide.
Figure 2:
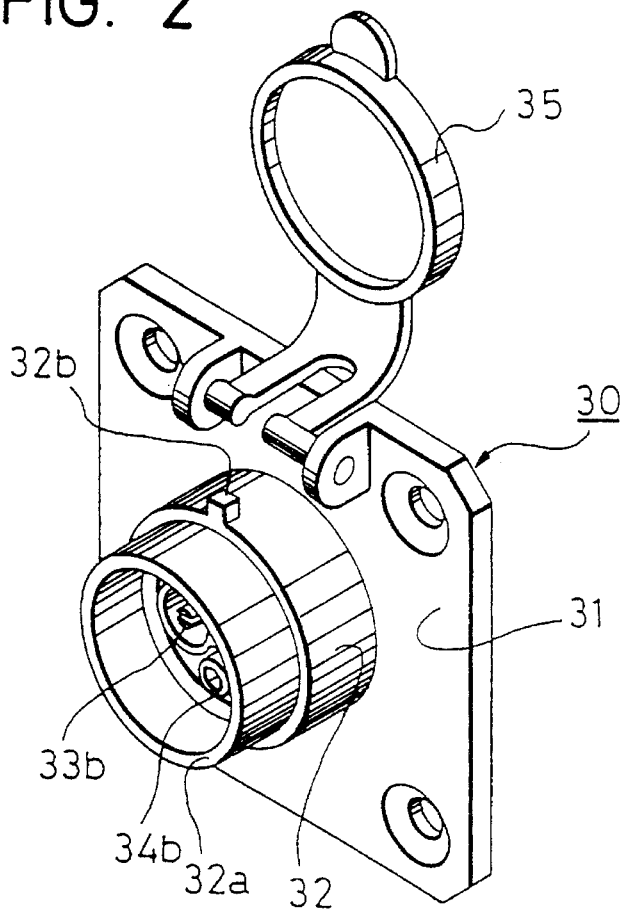
FIG. 2 is a perspective view of a battery-side connector.

FIG. 1 is a perspective view of a charger-side connector that is one preferred embodiment of a connector of the invention having a rotation guide, and FIG. 2 is a perspective view of a mating battery-side connector.

In the charger-side connector, a cylindrical outer tube 20 is rotatably mounted on an outer periphery of a cylindrical inner tube 10, the outer tube 20 being not movable back and forth relative to the inner tube 10. Power terminals 11*a* and 11*b* for supplying a charging power, as well as signal terminals 12*a* and 12*b* for transferring information concerning the charging, are provided in one end portion of the inner tube 10. The power terminals 11*a* and 11*b* are slightly longer than the signal terminals 12*a* and 12*b*. Wires, connected to the power terminals 11*a* and 11*b* and the signal terminals 12*a* and 12*b* within the inner tube 10, are extended outwardly from the other end of the inner tube 10.

The rear end portion of the inner tube 10 from which the wires are extended serves as a grip portion 13, and three straight grooves 14*a* to 14*c* of an arcuate cross-section are formed in the outer periphery of the inner tube 10 including the grip portion 13, and extend in the axial direction.

Figure 3:
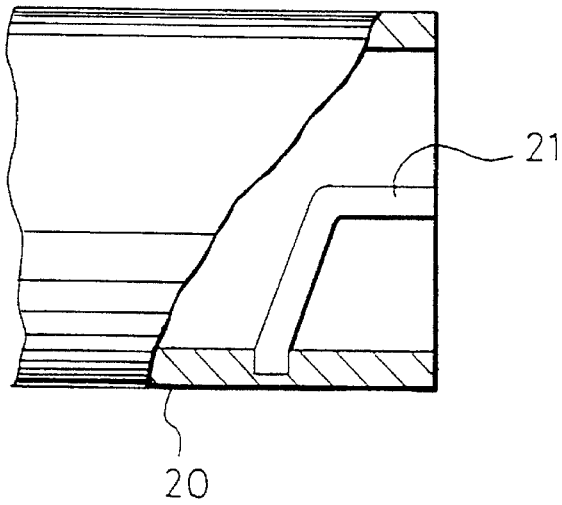
FIG. 3 is a partial sectional view showing a guide groove formed in an outer tube.

The outer tube 20 is provided around the front end portion of the inner tube 10 at which the power terminals 11*a* and 11*b* and the signal terminals 12*a* and 12*b* are provided, and a spiral guide groove 21 which is open-at its one end to the front end of the outer tube 20 is formed in the inner periphery of the front end portion of the outer tube 20, as shown in FIG. 3. The guide groove 21 is formed at a region extending over an angle of about 90 degrees, and this pitch of 90 degrees is designed to be a length necessary for connection and disconnection of the connectors.

Figure 4:
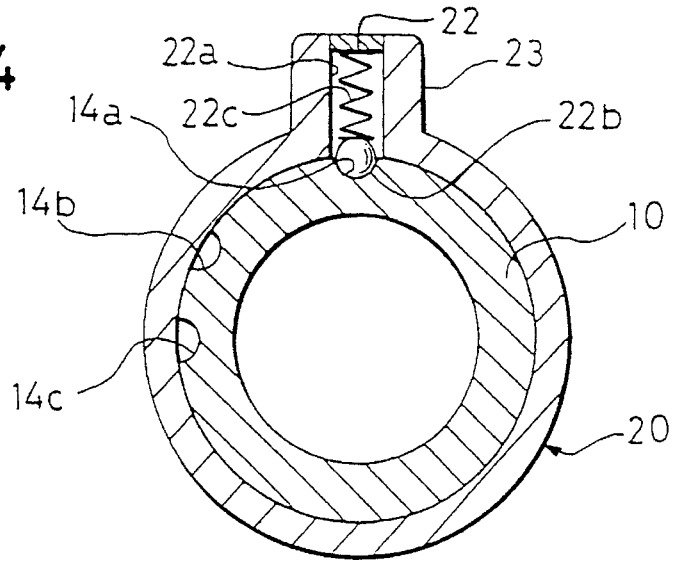
FIG. 4 is a cross-sectional view of the charger-side connector taken along the line A—A in a non-connected condition.

A finger support portion 23 incorporating plunger mechanisms 22 is formed on and projected from the rear end portion of the outer tube 20. As shown in FIG. 4, the plunger mechanism 22 comprises a tubular portion 22*a* which is formed radially in the finger support portion 23 and leads to the inner peripheral surface, a plunger ball 22*b* received in the tubular portion 22*a*, and a spring 22*c* received in the tubular portion 22*a* and urging the plunger ball 22*b* toward the inner peripheral surface. The plunger ball 22*b* is slightly smaller than the bore diameter of the tubular portion 22*a*, and is retainingly engageable in the straight grooves 14*a* to 14*c*.

Figure 5:
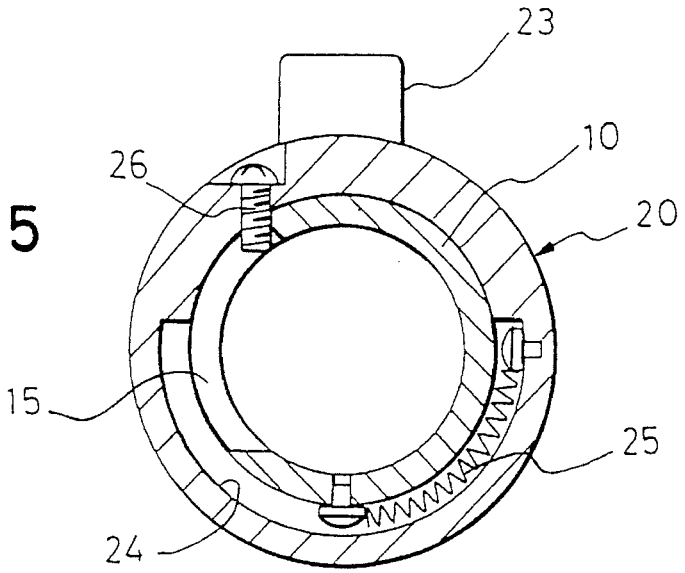
FIG. 5 is a cross-sectional view of the charger-side connector taken along the line B—B in the non-connected condition.

As shown in FIG. 5, a spring track groove 24 is formed in a generally central portion of the outer tube 20 over a lower half of the circular outer tube 20. A spring 25 is received in the spring track groove 24, and one end of the spring 25 is fixedly secured by a screw to one end of the spring track groove 24, and the other end of this spring 25 is fixedly secured by a screw to a lowermost portion of the inner tube 10. On the other hand, a rotation limitation groove 15 is formed in the inner tube 10 over an angle of about 90 degrees, whereas a rotation limitation pin 26 is mounted on the outer tube 20, and is received at its distal end in the rotation limitation groove 15. The range of angular movement of the rotation limitation pin 26 in the rotation limitation groove 15 is equal to the range of expansion and contraction of the spring 25 in the spring track groove 24 over an angle of 90 degrees.

The battery-side connector 30 comprises a flat base portion 31, and a terminal portion 32 projected from a central portion of the base portion 31. Power terminals 33*a* and 33*b* and signal terminals 34*a* and 34*b* are provided in the terminal portion 32 in such a manner that these power terminals and these signal terminals can be disposed in facing relation to the power terminals 11*a* and 11*b* and the signal terminals 12*a* and 12*b*, respectively. The power terminals 33*a* and 33*b* are slightly longer than the signal terminals 34*a* and 34*b*. The peripheral edge portion of the terminal portion 32 is defined by a cylindrical hood portion 32*a* which surrounds the power terminals 33*a* and 33*b* and the signal terminals 34*a* and 34*b*, and is projected so as to be disposed in facing relation to the inner tube 10. A positioning projection 32*b* for being received in the guide groove 21 is formed on the outer peripheral surface of this hood portion at an upper side thereof. A waterproof cap 35 for closing an open end of the hood portion 32*a* is pivotally mounted on the upper portion of the base portion 31.

In this embodiment, after the signal terminals 12*a* and 12*b* of the charger-side connector are connected respectively to the signal terminals 34*a* and 34*b* of the battery-side connector, electric power for charging purposes is supplied to the power terminals 11*a* and 11*b*. Each of the terminals is supported for sliding movement in the axial direction, and is urged toward the open side with a predetermined force.

The operation of this embodiment of the above construction will now be described.

In the plunger mechanisms 22 mounted in the finger support portion 23, the plunger ball 22*b* is urged against the outer peripheral surface of the inner tube 10, and the plunger ball 22*b* is first received in the straight groove 14*a* to retain the outer tube 20 relative to the inner tube 10, as shown in FIG. 4. At this time, the rotation limitation pin 26 of the outer tube 20 received in the rotation limitation groove 15 in the inner tube 10 is positioned at one end of the rotation limitation groove 15, as shown in FIG. 5, and is movable in the rotation limitation groove 15 within a range of counterclockwise rotation of the outer tube 20 through 90 degrees. As described above, the spring 25 is fixedly secured at its opposite ends to the outer tube 20 and the inner tube 10, and is held in the spring track groove 24, and this spring urges the outer tube 20 in a clockwise direction, as shown in FIG. 5.

Figure 6:
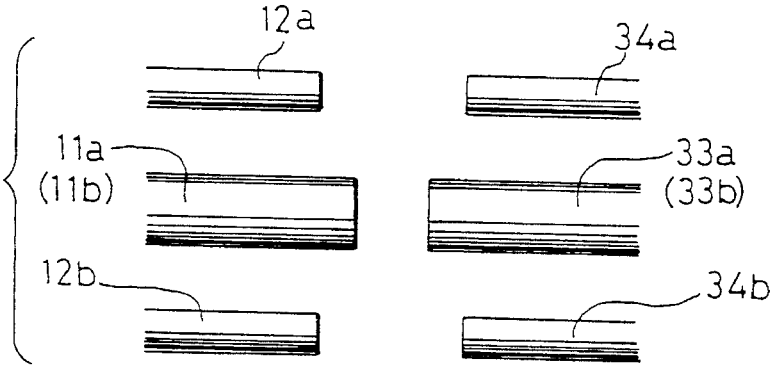
FIG. 6 is a view showing the positional relation of terminals in the non-connected condition.

The waterproof cap 35 is pivotally moved from the hood portion 32*a* of the battery-side connector to open the terminal portion 32, and the charger-side connector is pushed to be fitted on the battery-side connector from its terminal side. At this time, this pushing is carried out in such a manner that the open end of the guide groove 21 open to the end of the outer tube 20 is disposed in registry with the positioning projection 32*b* on the terminal portion 32. When the charger-side connector is pushed linearly, the positioning projection 32*b* is abutted against the side wall of the groove 21, so that it can not be pushed further. At this time, any of the terminals is not in a contacted condition, as shown in FIG. 6.

Figure 7:
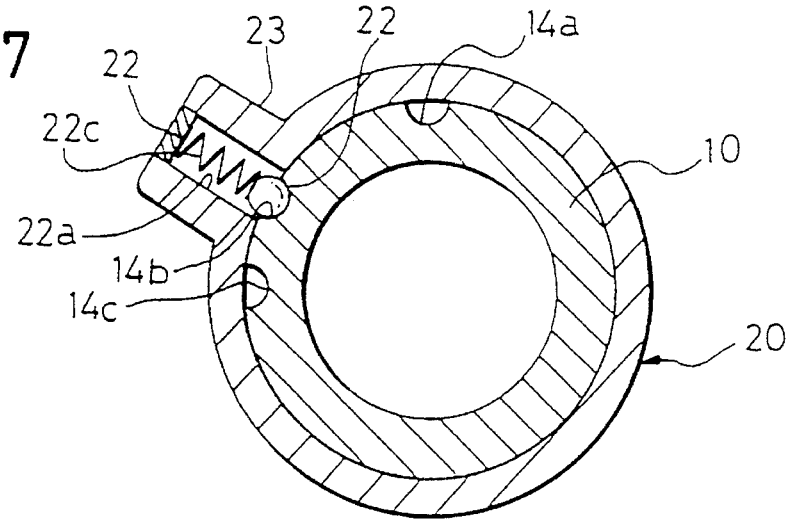
FIG. 7 is a cross-sectional view of the charger-side connector taken along the line A—A of FIG. 1 in the process of connection.
Figure 8:
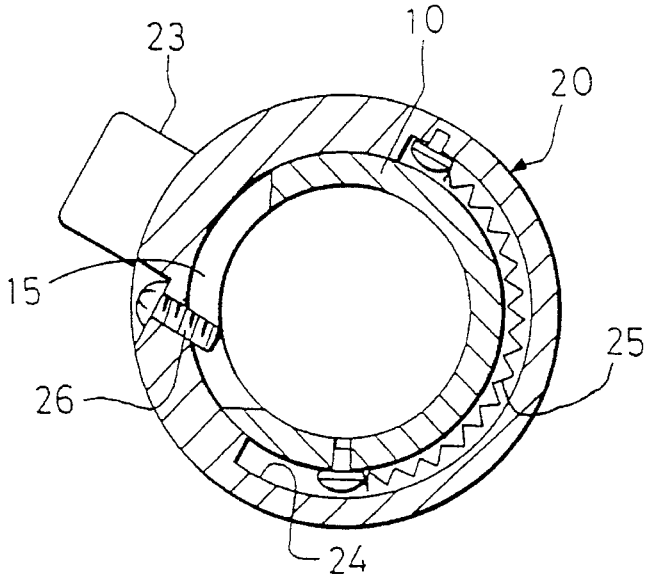
FIG. 8 is a cross-sectional view of the charger-side connector taken along the line B—B of FIG. 1 in the process of connection.

While holding the grip portion 13, the finger support portion 23 is pushed in a counterclockwise direction, the plunger ball 22*b* of each plunger mechanism 22 is disengaged from the straight groove 14*a*, thereby releasing the retaining of the outer tube 20 relative to the inner tube 10. Since the outer tube 20 continues to rotate, each plunger ball 22*b* slidingly moves over the outer peripheral surface of the inner tube 10, and is received in the next straight groove 14*b*, thereby retaining the outer tube 20 relative to the inner tube 10, as shown in FIG. 7. At this time, the positional relationship between the rotation limitation pin 26 and the rotation limitation groove 15 is as shown in FIG. 8.

Figure 9:
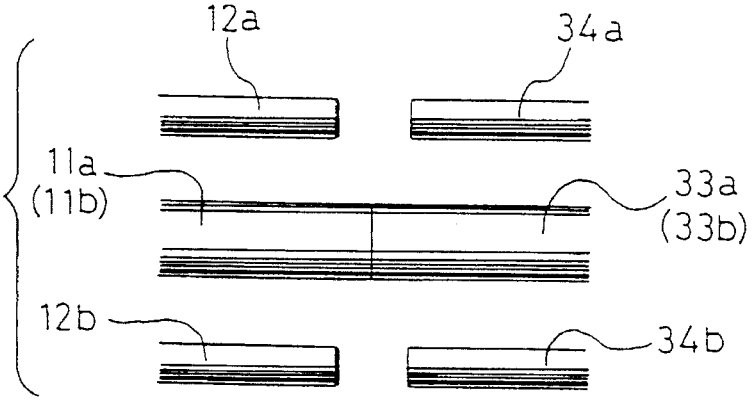
FIG. 9 is a view showing the positional relation of the terminals in the process of connection.

At the time when each plunger ball 22*b* becomes received in the straight groove 14*b*, the power terminals 11*a* and 11*b* of the charger-side connector are connected respectively to the power terminals 33*a* and 33*b* of the battery-side connector, as shown in FIG. 9. If the force for rotating the outer tube 20 is released before the plunger balls 22*b* are received in the straight groove 14*b*, the outer tube 20 is returned to its initial rotational position under the influence of the spring 25, and therefore the connection between the power terminals 11*a* and 11*b* and the power terminals 33*a* and 33*b* is not established.

Figure 10:
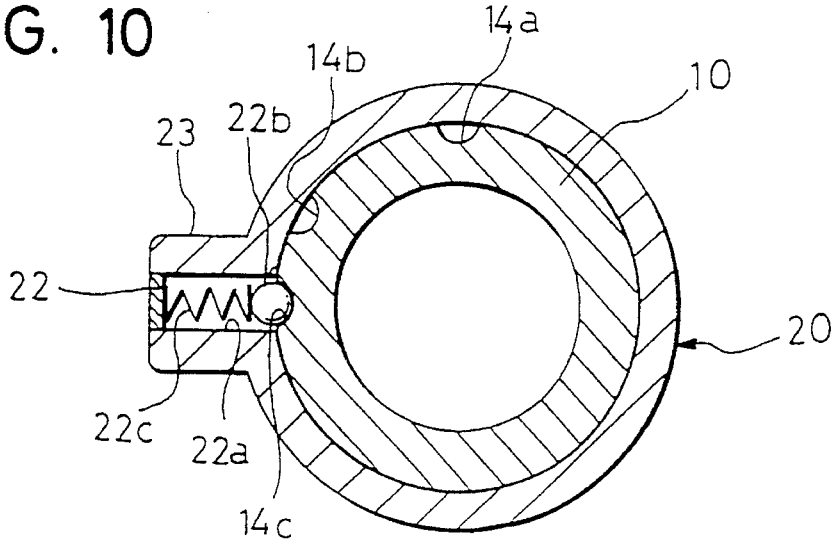
FIG. 10 is a cross-sectional view of the charger-side connector taken along the line A—A of FIG. 1 in a connected condition.
Figure 12:
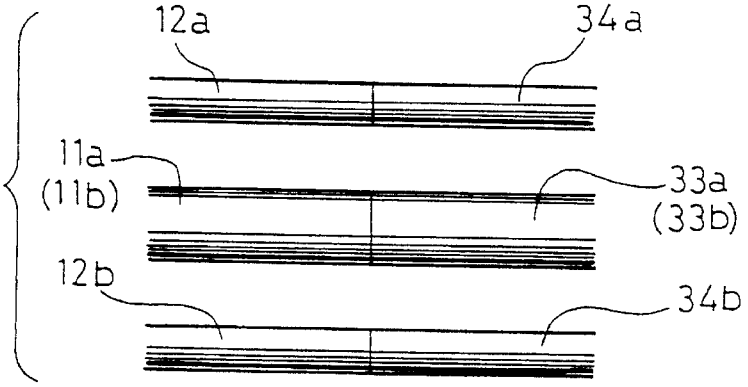
FIG. 12 is a view showing the positional relation of the terminals in the connected condition.
Figure 13:
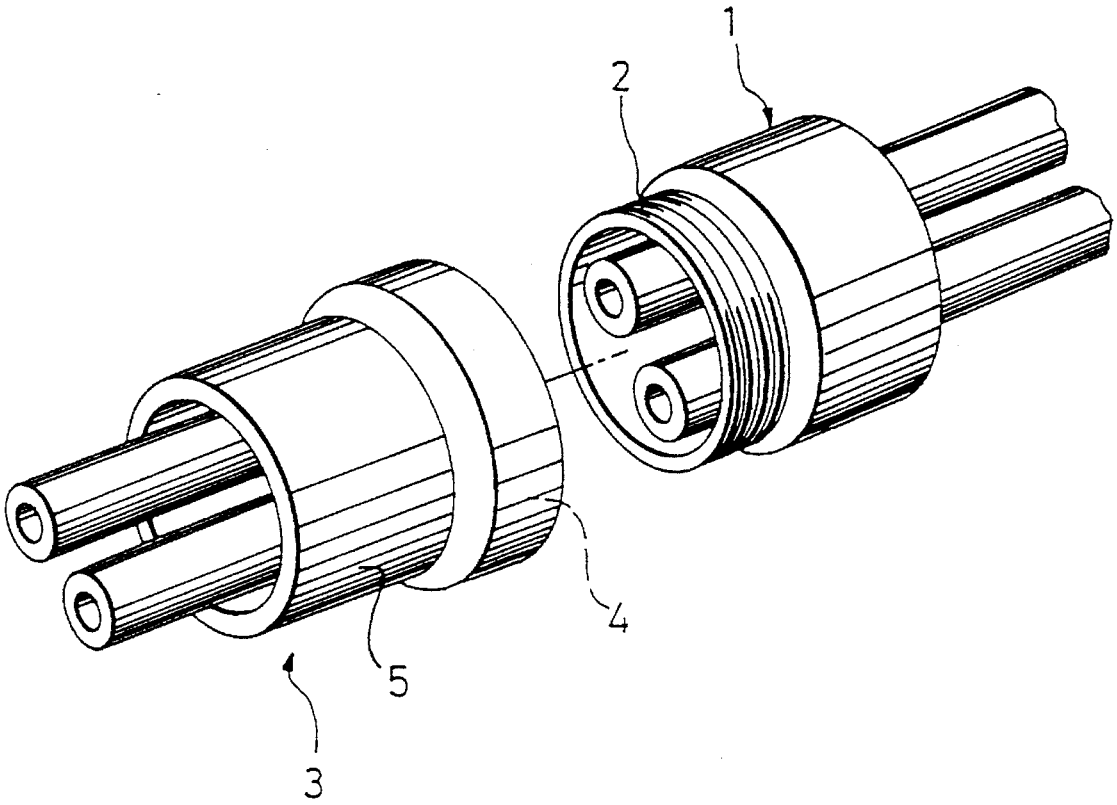
PRIOR ART FIG. 13
FIG. 13 is a perspective view of a conventional connector with rotation guide means.

When the finger support portion 23 is further pushed in a counterclockwise direction, the plunger mechanisms 22 release the retaining of the outer tube 20 relative to the inner tube 10, and then when the outer tube 20 is rotated through 90 degrees, each plunger ball 22*b* becomes received in the next straight groove 14*c*, thereby retaining the outer tube 20 relative to the inner tube 10, as shown in FIG. 10. At the time when each plunger ball 22*b* becomes received in the straight groove 14*c*, the signal terminals 12*a* and 12*b* of the charger-side connector are connected respectively to the signal terminals 34*a* and 34*b* of the battery-side connector, as shown in FIG. 12.

As described above, the power terminals 11*a* and 11*b* are longer than the signal terminals 12*a* and 12*b*, and the power terminals 33*a* and 33*b* are longer than the signal terminals 34*a* and 34*b*, and therefore when the signal terminals 12*a* and 12*b* are connected respectively to the signal terminals 34*a* and 34*b*, the power terminals 11*a* and 11*b* have already been connected respectively to the power terminals 33*a* and 33*b*. Therefore, after confirming the connection of the signal terminals 12*a* and 12*b* to the signal terminals 34*a* and 34*b*, charging power is supplied to the power terminals 11*a* and 11*b*. By doing so, there can be avoided a situation in which heat is generated as a result of supplying the power in a half-connected condition of the terminals.

If the rotation of the outer tube 20 is stopped when the plunger balls 22*b* are being moved from the straight groove 14*b* to the straight groove 14*c*, the outer tube 20 is returned toward the initial position by the spring 25, and is stopped at the position where the plunger balls 22*b* are received in the straight groove 14*b*. If the signal terminals 12*a* and 12*b* are half connected to the signal terminals 34*a* and 34*b*, respectively, there may be encountered a situation in which electric power is supplied or not supplied to the power terminals 11*a* and 11*b*; however, if the plunger balls 22*b* are thus not received in the straight groove 14*c*, the outer tube is returned to the position where the plunger balls are received in the straight groove 14*b*, and therefore such a situation will not be encountered.

Figure 11:
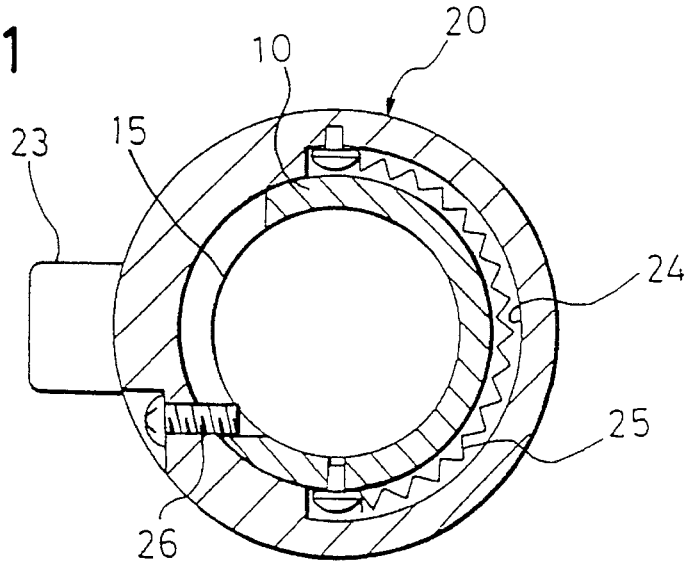
FIG. 11 is a cross-sectional view of the charger-side connector taken along the line B—B of FIG. 1 in the connected condition.

When the plunger balls 22*b* are received in the straight groove 14*c*, the rotation limitation pin 26 is located at the other end of the rotation limitation groove 15, as shown in FIG. 11, and therefore the outer tube 20 can not be rotated further.

As described above, during the rotation of the outer tube 20, the connected condition of the terminals can be judged at a glance from the position of the outer tube 20 relative to the straight grooves 14*a* to 14*c* in the outer peripheral surface of the inner tube 10, and therefore the operator can properly judge when rotating the outer tube 20, and this prevents the operator from rotating the outer tube halfway.

thus, by rotating the outer tube 20, the outer tube 20 and the inner tube 10 are moved toward the battery-side connector 30 through the engagement of the positioning projection 32*b* in the guide groove 21, and at this time the outer tube 20 is retained relative to the inner tube 10 in predetermined relation thereto by the straight grooves 14*a* to 14*c* and the plunger mechanisms 22. Therefore, when the outer tube is disposed in the retaining position in accordance with the connected condition of the terminals, the rotational condition as viewed from the outside represents the connected condition of the terminals.

In this embodiment, although the pin-like positioning projection 32*b* and the spiral guide groove 21 are provided at the battery-side connector and the charger-side connector, respectively, they may be replaced by an externally-threaded portion and an internally-threaded portion which have a large pitch.

What is claimed is:

1. An electrical connector with rotation guide means, comprising:

an inner tube in which terminals are held therein having a rotation limitation groove formed therein;

an outer tube having a spiral engagement groove formed therein and a rotation limitation pin coupled thereto, rotatably mounted on an outer periphery of said inner tube wherein said rotation limitation pin engages said rotation limitation groove and restricts a movable rotation range of said outer tube relative to said inner tube, said outer tube adapted to be inserted into a mating connector having an engagement projection formed, and wherein when said outer tube is rotated with the engagement projection engaged in said engagement groove, the two connectors move toward and away from each other depending on the rotation direction of the outer tube;

spring means for urging said outer tube with respect to said inner tube toward a start position, where said outer tube is disposed before starting electrical connection to the mating connector, from a completed position, where said outer tube is disposed after completing electrical connection to the mating connector; and retaining means for retaining said outer tube and said inner tube at predetermined positions against the urging force of said spring means so that said outer and inner tubes can be disposed in a predetermined rotational relationship to each other.

2. The electrical connector as claimed in claim 1, wherein said retaining means comprises plunger means mounted on said outer tube and biased toward an outer peripheral surface of said inner tube, and wherein said inner tube has straight grooves formed on the outer peripheral surface thereof extending along a longitudinal axis thereof, said plunger means being selectively engageable in said straight grooves.

3. A connector as claimed in claim 1, wherein said outer tube is rotatably mounted on the outer periphery of said inner tube but is axially immovable relative to the inner tube.

4. The electrical connector as claimed in claim 1, wherein said inner tube holds a pair of power terminals for supplying a charging power, and a pair of signal terminals for transmitting information concerning charging, wherein the power terminals are slightly longer than the signal terminals.

5. The electrical connector as claimed in claim 4, wherein electric power for charging is supplied to said power terminals after said signal terminals are connected.

6. The electrical connector as claimed in claim 1, wherein said spiral engagement groove is formed at a region of said outer tube extending over an angle of about 90 degrees and has a pitch designed to be a length necessary for connection and disconnection of the connector and the mating connector.

7. The electrical connector as claimed in claim 2, wherein said plunger means comprises a tubular portion projected from said outer tube, a plunger ball received in said tubular portion, and plunger spring means received in the tubular portion for urging said plunger ball toward the outer peripheral surface of said inner tube, said plunger ball being slightly smaller than a bore diameter of said tubular portion and retainingly engageable in said straight grooves.

8. A connector as claimed in claim 1, wherein said outer tube includes a spring track groove for receiving said spring means, one end of said spring means being fixedly secured to one end of said spring track groove and the other end of said spring means being fixedly secured to a portion of said inner tube.

9. An electrical connector comprising:

an inner tube containing an electrical terminal assembly and having a plurality of retaining grooves formed thereon;

an outer tube surrounding the inner tube and rotatable with respect to the inner tube, having a guide groove formed therein for interconnection with a complementary electrical connector;

a retaining mechanism coupled to the outer tube that releasably retains the outer tube with respect to the inner tube in a plurality of discrete positions including a first position in which no electrical connection is made with the complementary connector and at least a second position in which electrical connection is made with made with the complementary connector, the retaining mechanism selectively engaging one of the retaining grooves upon rotation of the outer tube with respect to the inner tube; and a biasing mechanism connected between the inner tube and the outer tube that biases the outer tube to rotate toward the first position.

10. The electrical connector of claim 9 wherein the electrical terminal assembly in the inner tube includes at least one signal terminal and at least one power terminal.

11. The electrical connector of claim 10 wherein the signal terminal extends outwardly from the inner tube farther than the power terminal thus making electrical connection with a mating signal terminal prior to electrical connection being made by the power terminal.

12. The electrical connector of claim 9 in combination with a complementary electrical connector comprising a terminal portion including an electrical terminal, wherein the terminal portion comprises a cylindrical hood having a projection thereon that mates with the guide groove of the outer tube of the connector.

13. The electrical connector of claim 9 wherein the guide groove in the outer tube has a longitudinal section and a spiral section and has a length corresponding to a length necessary for connection and disconnection of the electrical terminal.

14. The electrical connector of claim 9 wherein the inner tube has three retaining grooves that correspond to the first position where no electrical connection is made with the complementary connector, a second position where partial electrical connection is made, and a third position where full electrical connection is made.

15. The electrical connector of claim 9 wherein the biasing mechanism comprises a spring track groove formed in one of the inner and outer tubes and spring positioned in the spring track groove and secured to the inner tube and the outer tube.

16. The electrical connector of claim 9 wherein the retaining mechanism comprises a plunger mechanism including a spring biased retaining formation that engages the retaining grooves.

17. The electrical connector of claim 16 wherein the plunger mechanism comprises a hollow finger support portion having at least one spring retained therein and a ball abutting the spring and biased thereby into engagement with said inner tube, wherein the ball is selectively received in one of the retaining grooves depending on rotation of the outer tube.

18. The electrical connector of claim 17 wherein the plunger mechanism comprises a pair of springs and abutting balls axially aligned with respect to the outer tube.

19. The electrical connector of claim 9 wherein each of the retaining grooves is an axially elongated groove extending past the outer tube to serve as a visual indicator of electrical connection.

* * * * *